United States Patent [19]

Beerse et al.

[11] Patent Number: 4,915,862

[45] Date of Patent: Apr. 10, 1990

[54] GRANULAR DETERGENT COMPOSITIONS CONTAINING CRUTCHED AND ADMIXED PHOSPHATE BUILDER SYSTEM

[75] Inventors: Lisa A. Beerse, Maineville; Keith H. Baker, Cincinnati, both of Ohio

[73] Assignee: The Procter & Gamble Company, Cincinnati, Ohio

[21] Appl. No.: 231,108

[22] Filed: Aug. 11, 1988

[51] Int. Cl.[4] ..... C11D 3/06; C11D 17/04

[52] U.S. Cl. ..... 252/90; 252/135; 252/539

[58] Field of Search ..... 252/99, 135, 539, 540

[56] References Cited

U.S. PATENT DOCUMENTS

| | | | |
|---|---|---|---|
| 3,344,076 | 9/1967 | Wilcox | 252/135 |
| 3,862,058 | 1/1975 | Nirschl et al. | 252/528 |
| 4,019,998 | 4/1977 | Benson et al. | 252/135 |
| 4,101,455 | 7/1978 | Francis et al. | 252/531 |
| 4,116,852 | 9/1978 | Bailey et al. | 252/135 |
| 4,165,334 | 8/1979 | Gosselink et al. | 260/458 R |
| 4,283,299 | 8/1981 | Becker et al. | 252/90 |
| 4,299,717 | 11/1981 | Cottrell et al. | 252/99 |
| 4,308,158 | 12/1981 | Gohla et al. | 252/97 |
| 4,348,293 | 9/1982 | Clarke et al. | 252/90 |
| 4,715,979 | 12/1987 | Moore et al. | 252/91 |

FOREIGN PATENT DOCUMENTS 0229671 7/1987 European Pat. Off. .

*Primary Examiner*—Prince E. Willis

*Attorney, Agent, or Firm*—Leonard Williamson; Robert B. Aylor; Richard C. Witte

[57] ABSTRACT

The invention is a fast dissolving granular detergent composition having a phosphate builder system comprising: crutched sodium tripolyphosphate and/or tetrasodium pyrophosphate and admixed sodium tripolyphosphate and/or tetrasodium pyrophosphate and preferably with a minimal of the admixed tetrasodium pyrophosphate. The preferred composition is used in combination with a water-permeable, water-insoluble pouch for a unit dose home laundry execution.

6 Claims, No Drawings

GRANULAR DETERGENT COMPOSITIONS CONTAINING CRUTCHED AND ADMIXED PHOSPHATE BUILDER SYSTEM

BACKGROUND OF THE INVENTION

1. The field of this invention is granular detergent compositions comprising phosphate builders, particularly sodium tripolyphosphate (STPP) and tetrasodium pyrophosphate (TSPP).

2. Phosphate built granular detergent compositions per se are known. The term "crutched" as used herein includes the usual subsequent step in which the material is "spray dried", unless otherwise specified. U.S. Pat. Nos. 4,165,334, Gosselink/Richmond/Wentler, issued Aug. 21, 1979; and 3,862,058, Nirschl/Gloss, issued Jan. 21, 1975, disclose detergent granular compositions comprising sodium tripolyphosphate (STPP) and disclose alkali metal pyrophosphates as suitable inorganic builders.

U.S. Pat. No. 4,019,998, Benson/Cherney/Collier, issued Apr. 26, 1977, discloses a pyrophosphate-silicate spray dried detergent with admixed glassy phosphate and less than 20% of alkali metal tripolyphosphate. This patent does not disclose any example of crutched and admixed STPP and TSPP.

U.S. Pat. No. 4,715,979, Moore/Evans/Hansen, issued Dec. 29, 1987, discloses an improved dissolving spray dried detergent with "little or no" (0–20%) pyrophosphate or anhydrous tripolyphosphate. This spray dried detergent is admixed with 0–300% of other builders and compacted and, optionally, admixed with 0–300% additional builders, etc. A pouched product is disclosed. No crutched, spray dried STPP/TSPP examples are disclosed.

U.S. Pat. No. 4,299,717, Cottrell et al., issued Nov. 10, 1981, discloses powder and bar sodium carbonate detergent compositions with a low level (1–12%) of pyrophosphate, other phosphates being below 5% by weight of the composition. The pyrophosphate may be spray dried or "post dosed to the composition." No example containing crutched and admixed STPP and TSPP is disclosed.

EPA 229,671 (Kao Corporation), published July 22, 1987, discloses a high-density (0.5 g/cc+) granular detergent with spray dried and admixed inorganic salts for flowability and solubility. No example of crutched (spray dried) and admixed STPP and/or TSPP is disclosed.

The problem with the prior art detergent granules which contain only a crutched (spray dried) or only an admixed phosphate builder system is that they suffer from inferior solubility.

SUMMARY OF THE INVENTION

This invention relates to a granular detergent composition having a phosphate builder system comprising:

(A) crutched phosphate builder selected from STPP and TSPP and mixtures thereof; wherein said crutched builder is in spray dried detergent granules; and (B) admixed phosphate builder selected from STPP and TSPP and mixtures thereof; and wherein (A) and (B) have a ratio of from about 1:25 to about 25:1; said phosphate builder system containing from 0% to about 50% of said admixed TSPP by weight of said phosphate builder system; and wherein said granular detergent composition comprises from about 5% to about 40% detergent surfactant and from about 10% to about 75% of said phosphate builder system.

The preferred composition of this invention is of a moderate density granule of about 0.4 g/cc.

This granule surprisingly has improved solubility over granules containing either all crutched or all admixed phosphate builder system.

DETAILED DESCRIPTION OF THE INVENTION

It has been surprisingly discovered that phosphate built granular detergent compositions comprising a phosphate builder system having a selected crutched/spray-dried phosphate builder component and a selected admixed phosphate builder component dissolve more rapidly than comparable granular compositions with only a crutched or an admixed phosphate builder system. A porous pouch product containing the granular detergent composition of this invention is a preferred execution, since a rapidly dissolving detergent is essential under the stress washing conditions created by using a porous pouch.

The present invention include provision for:

1. A fast dissolving phosphate built granular detergent composition;
2. A moderate density phosphate built granular detergent composition of about 0.4 g/cc±0.2;
3. A mixed crutched/admixed phosphate built system; and
4. A fast dissolving granular detergent composition in a porous pouch.

The builder system of the present invention comprises:

(A) crutched/spray-dried builder component selected from STPP and TSPP and mixtures thereof; wherein said crutched builder components in spray dried detergent granules; and (B) admixed builder component selected from STPP and TSPP and mixtures thereof; and wherein (A) and (B) have a ratio of from about 1:25 to about 25:1; said builder system containing from 0% to about 50% of said admixed TSPP by weight of the builder system.

The granular detergent comprises from about 5% to about 40% detergent surfactant and from about 10% to about 75% of said phosphate builder system.

The surfactant is preferably used at levels of about 10–30% and more preferably at about 15–25%. The phosphate builder system is preferably used at levels of about 20–60% and more preferably at about 30–50%.

The ratio of the phosphate builder system components (A) and (B) are preferably from about 10:1 to about 1:10, more preferably from about 5:1 to about 1:5, and most preferably from about 3:1 to about 1:3. The builder system of this invention provides increased solubility at the more preferred ratios. Conductivity is a measurement of solubility. Solubility is determined by measuring the time it takes a wash solution to react 95% of the maximum electrical conductivity provided by the detergent granules.

The preferred crutched builder component (A) contains STPP and TSPP at the following ratios: from about 0:1 to about 1:0 from about 10:1 to about 1:10; or from about 3:1 to about 1:3. The admix component (B) can contain STPP and TSPP at ratio of from about 1:0 to about 0:1, preferably from about 1:0 to about 1:1, and more preferably from about 1:0 to about 2:1.

Suitable surfactants useful in the present invention are selected from the group consisting of anionic, nonionic, ampholytic and zwitterionic. Examples of synthetic detergents of these types are disclosed in above-cited U.S. Pat. Nos. 4,165,334; 3,862,058; 4,019,998; 4,715,979; 4,299,717; and EPA 229,671; all of said patents and application being incorporated herein by reference in their entirety.

In addition to the essential phosphate builder system, the usual optional builders can be used. Examples of optional builder salts are included in said incorporated patents.

Other optionals include other compatible ingredients used in granular detergents. Such ingredients are disclosed in said cited, incorporated by reference, patents.

EXAMPLES

The invention will be better understood in the light of the following nonlimiting examples.

TABLE I

| | Example 1 | |
|---|---|---|
| | g/sheet | parts |
| Crutched/Spray Dried Ingredient | | |
| Sodium $C_{11.8}$ linear alkyl benzene sulfonate ($C_{11.8}$ LAS) (100 active basis) | 10.70 | 13.51 |
| Sodium $C_{14-15}$ alkyl sulfate ($C_{45}$ AS) (100% active basis) | 4.59 | 5.79 |
| Sodium sulfate | 9.90 | 12.50 |
| Sodium silicate (1.6r) | 4.63 | 5.85 |
| Polyethylene glycol (Avg. MW approx. 8000) | 0.48 | 0.61 |
| Sodium polyacrylate (Avg. MW approx. 4500) | 0.47 | 0.59 |
| $C_{12-13}$ alkyl polyethoxylate (6.5) (Neodol 23-6.5) | 1.36 | 1.72 |
| Sodium tripolyphosphate | 11.03 | 13.93 |
| Tetrasodium pyrophosphate | 5.35 | 6.75 |
| Optical brightener | 0.17 | 0.21 |
| DTPA (chelant) | 0.42 | 0.53 |
| Unreacted | 0.16 | 0.20 |
| Water | 4.22 | 5.33 |
| Total Base Granule | 53.48 | 67.52 |
| Admixed Ingredient | | |
| Sodium carbonate | 7.34 | 9.27 |
| Sodium tripolyphosphate | 17.40 | 21.97 |
| Tetrasodium pyrophosphate | — | — |
| Savinase enzyme (protease) | 0.59 | 0.74 |
| Silicone/PEG coflake (5/95) | 0.30 | 0.38 |
| Perfume | 0.10 | 0.13 |
| Finished Product | 79.21 | 100.00 |
| Granule Properties | | |
| Base granule density (g/cc) | 0.34 | |
| Flow properties | Good | |
| 40° F. conductivity time (min.) | 1.88 | |

TABLE II

| | Example 2 | |
|---|---|---|
| | g/sheet | parts |
| Crutched/Spray Dried Ingredient | | |
| Sodium $C_{11.8}$ linear alkyl benzene sulfonate ($C_{11.8}$ LAS) (100 active basis) | 10.70 | 13.17 |
| Sodium $C_{14-15}$ alkyl sulfate ($C_{45}$ AS) (100% active basis) | 4.59 | 5.65 |
| Sodium sulfate | 9.90 | 12.19 |
| Sodium silicate (1.6r) | 4.63 | 5.70 |
| Polyethylene glycol (Avg. MW approx. 8000) | 0.48 | 0.59 |
| Sodium polyacrylate (Avg. MW approx. 4500) | 0.47 | 0.58 |
| $C_{12-13}$ alkyl polyethoxylate (6.5) (Neodol 23-6.5) | 1.36 | 1.67 |

TABLE II-continued

| | Example 2 | |
|---|---|---|
| | g/sheet | parts |
| Sodium tripolyphosphate | 9.89 | 12.17 |
| Tetrasodium pyrophosphate | 4.57 | 5.63 |
| Optical brightener | 0.17 | 0.21 |
| DTPA (chelant) | 0.42 | 0.52 |
| Unreacted | 0.16 | 0.20 |
| Water | 4.31 | 5.31 |
| Total Base Granule | 51.65 | 63.58 |
| Admixed Ingredient | | |
| Sodium carbonate | 7.34 | 9.03 |
| Sodium tripolyphosphate | 21.26 | 26.17 |
| Tetrasodium pyrophosphate | — | — |
| Savinase enzyme (protease) | 0.59 | 0.73 |
| Silicone/PEG coflake (5/95) | 0.30 | 0.37 |
| Perfume | 0.10 | 0.12 |
| Finished Product | 81.24 | 100.00 |
| Granule Properties | | |
| Base granule density (g/cc) | 0.36 | |
| Flow properties | Good | |
| 40° F. conductivity time (min.) | 2.28 | |

TABLE III

| | Example 3 | |
|---|---|---|
| | g/sheet | parts |
| Crutched/Spray Dried Ingredient | | |
| Sodium $C_{11.8}$ linear alkyl benzene sulfonate ($C_{11.8}$ LAS) (100 active basis) | 10.70 | 14.75 |
| Sodium $C_{14-15}$ alkyl sulfate ($C_{45}$ AS) (100% active basis) | 4.59 | 6.33 |
| Sodium Sulfate | 7.99 | 11.02 |
| Sodium Silicate (1.6r) | 4.63 | 6.38 |
| Polyethylene glycol (Avg. MW approx. 8000) | 0.48 | 0.66 |
| Sodium polyacrylate (Avg. MW approx. 4500) | 0.49 | 0.68 |
| $C_{12-13}$ alkyl polyethoxylate (6.5) (Neodol 23-6.5) | 1.36 | 1.88 |
| Sodium tripolyphosphate | 22.03 | 30.38 |
| Tetrasodium pyrophosphate | 5.35 | 7.38 |
| Optical brightener | 0.17 | 0.23 |
| DTPA (chelant) | — | — |
| Unreacted | 0.16 | 0.22 |
| Water | 6.24 | 8.60 |
| Total Base Granule | 64.19 | 88.51 |
| Admixed Ingredient | | |
| Sodium carbonate | 7.34 | 10.12 |
| Sodium tripolyphosphate | — | — |
| Tetrasodium pyrophosphate | — | — |
| Savinase enzyme (protease) | 0.59 | 0.81 |
| Silicone/PEG coflake (5/95) | 0.30 | 0.41 |
| Perfume | 0.10 | 0.14 |
| Finished Product | 72.52 | 100.00 |
| Granule Properties | | |
| Base granule density (g/cc) | 0.59 | |
| Flow properties | Good | |
| 40° F. conductivity time (min.) | 4.38 | |

EXAMPLE 1

Referring to Example 1 in Table I, components of the crutched/spray-dried ingredient (detergent base granule) of this formula are crutched at a temperature of 180° F. (82.2° C.) with a moisture of 37.6%. The crutcher mix is then granulated by spray-drying to a moisture of 7.89%. The base granule is admixed with the remaining dry ingredients in a static mixer with baffles. This formula has a phosphate builder system consisting of 32.7% crutched STPP, 15.8% crutched TSPP, and 51.5% admixed light density STPP. The formula contains 42.65% total phosphate by weight.

The formula of this example has a conductivity time, at 40° F. (4.2° C.), of 1.88 minutes and is the overall preferred mode of this invention. The ratio of crutched and admixed phosphate builder system is about 1:1.1. The level of surfactant is about 21.02% and the level of the phosphate builder system is about 42.65%. The density of the formula is about 0.4 g/cc.

EXAMPLE 2

Referring to Table II, Example 2 is similar to Example 1. Key differences include a base granule moisture of 8.34% and a phosphate builder system consisting of 27.7% crutched STPP, 12.8% crutched TSPP, and 59.5% admixed light density STPP. This formula contains 43.97% total phosphate by weight and has a conductivity time, at 40° F. (4.2° C.), of 2.28 minutes. The formula of this example is the best mode of this invention.

The ratio of crutched to admixed phosphates in the builder system is about 1:1.5. The surfactant level is about 20.49% and the level of the builder system is about 43.97%. The density of the formula is 0.4 g/cc.

COMPARATIVE EXAMPLE 3

Example 3 illustrates the critical importance of the composition of the phosphate builder system, in terms of crutched STPP, crutched TSPP, admixed light density STPP, and admixed TSPP, on the solubility of a detergent granule. Base granule moisture of this formula is 9.72% and total phosphate by weight is 37.76%. The phosphate system consists of 80.5% crutched STPP and 19.5% crutched TSPP. The 40° F. (4.2° C.) conductivity time of this formula is 4.38 minutes. This formula is outside of the invention.

Thus, there is a big difference between the solubility conductivity of the above examples, i.e., 1.88 and 2.28 minutes vs. 4.38 minutes. The products of the present invention are superior over those with just a crutched or admixed phosphate builder system.

The granular detergent composition of Examples 1 and 2 are put into a porous, water-insoluble, dual-chambered pouch made of carded thermobonded, nonwoven material made from polyester fibers coated with polypropylene having a basis weight of 37 grams per square yard, said pouch having overall dimensions of about 14.5 cm by about 18.6 cm with an about 0.64 cm heat sealed border and an about 0.64 cm heat seal at the center of the 18.6 cm sides to form two separate chambers. The two chambers are filled with a total of 72.52 grams of product.

What is claimed is:

1. A granular detergent composition having a phosphate builder system comprising:

(A) a crutched builder comprising sodium tripolyphosphate (STPP) and tetrasodium pyrophosphate (TSPP) having a crutched STPP/TSPP ratio of from 3:1 to 1:3; wherein said crutched builder is in a spray dried detergent granule; and (B) an admixed builder selected from STPP and TSPP and a mixture thereof; and wherein the builders of said (A) and said (B) have a crutched/admixed ratio of from about 1:5 to about 5:1; wherein said phosphate builder system contains from 0% to about 50% of said admixed TSPP by weight of the builder system; and wherein said granular detergent composition comprises from about 5% to about 40% surfactant and from about 10% to about 75% of said builder system by weight of said composition.

2. The granular detergent composition of claim 1 wherein said builder system contains from 0% to about 35% of said admixed TSPP; said composition comprises from about 10% to about 40% surfactant and from about 20% to about 6h% of said phosphate builder system.

3. The granular detergent composition of claim 2 wherein said composition comprises from about 10% to about 30% of said surfactant and from about 30% to about 50% of said phosphate builder system.

4. The granular detergent composition of claim 3 wherein said ratio of (A) and (B) is about 3:1 to about 1:3.

5. The granular detergent composition of claim 1 wherein said STPP and TSPP in (B) has a ratio of about 1:0 to about 1:1.

6. A porous pouch containing the granular detergent of claim 1.

* * * * *

UNITED STATES PATENT AND TRADEMARK OFFICE

CERTIFICATE OF CORRECTION

PATENT NO. : 4,915,862

DATED : April 10, 1990

INVENTOR(S) : LISA A. BEERSE and KEITH H. BAKER

It is certified that error appears in the above-identified patent and that said Letters Patent is hereby corrected as shown below:

IN THE CLAIMS:

Col. 6, line 30, "6h%" should read -- 60% --.

Signed and Sealed this

Tenth Day of March, 1992

*Attest:*

HARRY F. MANBECK, JR.

*Attesting Officer*

*Commissioner of Patents and Trademarks*